United States Patent [19]

Andrews

[11] Patent Number: 4,951,270

[45] Date of Patent: Aug. 21, 1990

[54] AUDIO TRANSDUCER APPARATUS

[76] Inventor: Jay E. Andrews, 32810 N. 227th Ave., Wittman, Ariz. 85361

[21] Appl. No.: 368,801

[22] Filed: Jun. 20, 1989

[51] Int. Cl.[5] ..... H04R 11/00

[52] U.S. Cl. ..... 367/140; 381/152; 381/162; 181/144; 181/171

[58] Field of Search ..... 381/152, 162, 205; 181/171, 144, 148, 157; 367/140

[56] References Cited

U.S. PATENT DOCUMENTS

| | | | |
|---|---|---|---|
| 3,430,007 | 2/1969 | Thielen | 381/152 |
| 3,524,027 | 8/1970 | Thurston et al. | 381/152 |
| 3,567,870 | 3/1971 | Rivera | 381/152 |
| 3,728,497 | 4/1973 | Komatsu | 381/152 |
| 4,385,210 | 5/1983 | Marquiss | 381/152 |

*Primary Examiner*—Charles T. Jordan
*Assistant Examiner*—J. Woodrow Eldred
*Attorney, Agent, or Firm*—H. Gordon Shields

[57] ABSTRACT

Transducer apparatus includes a two-part housing having a rear boss for securing the transducer to a wall. Within the housing are two magnetic elements for providing an output in response to electrical input signals, and the output is transmitted to the wall through the housing and rear boss. The magnetic elements are secured within the housing by the internal configuration of the housing.

14 Claims, 1 Drawing Sheet

AUDIO TRANSDUCER APPARATUS

BACKGROUND OF THE INVENTION

1. Field of the Invention

This invention relates to audio transducers and, more particularly, to audio transducers designed to be secured to a wall to cause the wall to act as an audio output element.

2. Description of the Prior Art

U.S. Pat. No. 1,383,700 (Egerton) discloses a transducer acoustic element designed to respond to acoustic signals propagated in air or water. The apparatus is designed to be secured to an element which will flex in response to received audio input signals.

U.S. Pat. No. 2,341,275 (Holland) describes a sound reproducing apparatus or transducer which vibrates in response to magnetic input and designed to be secured to an element ot make the element provide an output. A sample output element is a glass window pane.

U.S. Pat. No. 3,666,749 (Reis) discloses an audio transducer designed to be secured to a wall to make the wall vibrate in response to the transducer output.

U.S. Pat. No. 3,430,007 (Thielen) discloses another type of audio transducer designed to be mounted to a wall. The apparatus includes a ring which contacts the wall about a screw element which is embedded in the wall. Vibrations are transmitted from the transducer to the wall through the ring element as well as through the screw.

U.S. Pat. No. 3,449,531 (Ashworth) discloses another type of transducer element securable to a wall to make the wall vibrate in response to the output of the transducer element. Several different examples are given in the patent of how the transducer apparatus may be secured to a wall.

U.S. Pat. No. 3,524,027 (Thurston et al) discloses another type of sound transducer designed to be mounted to a wall. The apparatus includes a diaphragm element which encloses electromagnetic elements. The vibrations of the diaphragm are in turn imparted through the wall.

U.S. Pat. No. 3,567,870 (Rivera) discloses another type of transducer to be mounted on a wall. The transducer includes a housing, with the electromagnetic components inside the housing, and with a circular boss that is disposed against a wall. The housing is of a generally circular configuration with generally flat tops and bottoms and curved other periphery. The housing is made of two substantially identical elements connected together at their outer edges.

U.S. Pat. No. 3,861,495 discloses a transducer element designed primarily for increasing or improving base response by securing a transducer to a relative large sound receiving panel.

U.S. Pat. No. 4,514,599 (Yanagishima et al) discloses a speaker designed for an automotive vehicle. The speaker is designed to be secured to a panel to cause the panel to act as a sound producing element. Numerous embodiments are disclosed in the patent.

SUMMARY OF THE INVENTION

The invention described and claimed herein comprises a transducer for transducing electromechanical signals into an audio output. The transducer includes housing and a magnet assembly and a tweeter in the housing, and the housing is securable to a wall structure or the like to cause the wall to become part of a speaker in providing an audio output. The housing includes two portions, with the tweeter secured to one portion and the means assembly secured to the other portion. The housing portions are secured together at their outer peripheries. The transducer apparatus also includes a boss extending outwardly from the housing and disposed against the wall surface. The portion of the housing that the boss is secured to is that portion of the housing to which the magnet assembly is secured. The tweeter is thus in the housing portion remote from the wall.

Among the objects of the present invention are the following:

To provide new and useful electromagnetic transducer apparatus;

To provide new and useful transducer apparatus securable to a wall to make the wall vibrate in response to the output of the transducer;

To provide new and useful transducer apparatus having a housing in which are secured audio output elements;

To provide new and useful housing apparatus for a transducer; and

To provide new and useful housing apparatus secured to a wall and having in the housing apparatus transducer elements for providing an audio output in response to electromagnetic input signals.

DESCRIPTION OF THE PREFERRED EMBODIMENT

Figure 1:
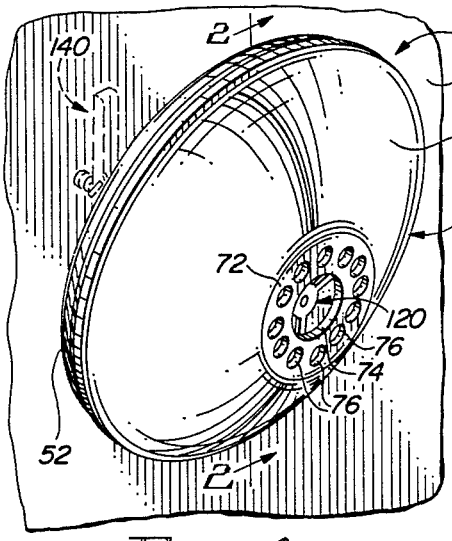
FIG. 1 is a perspective view of the apparatus of the present invention in its use environment.
Figure 2:
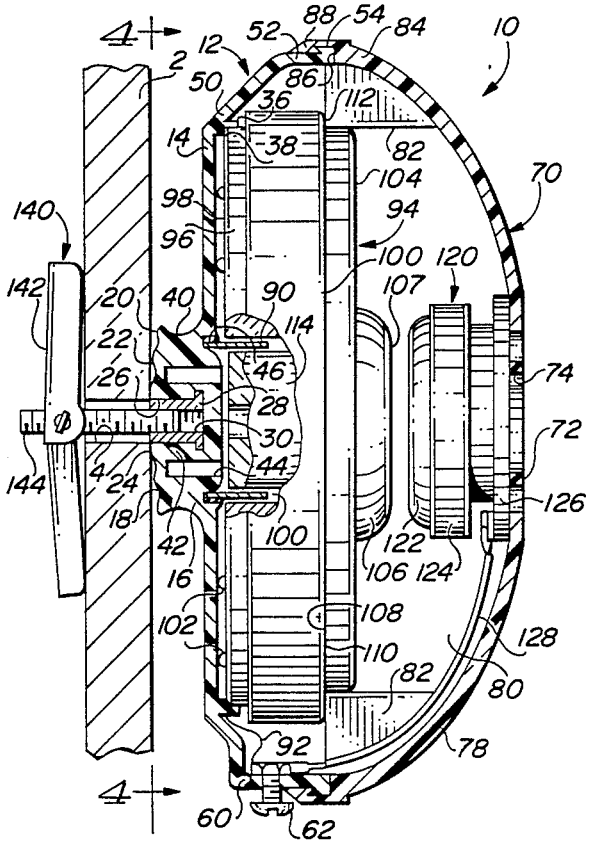
FIG. 2 is a view in partial section taken generally along line 2—2 of FIG. 1.
Figure 3:
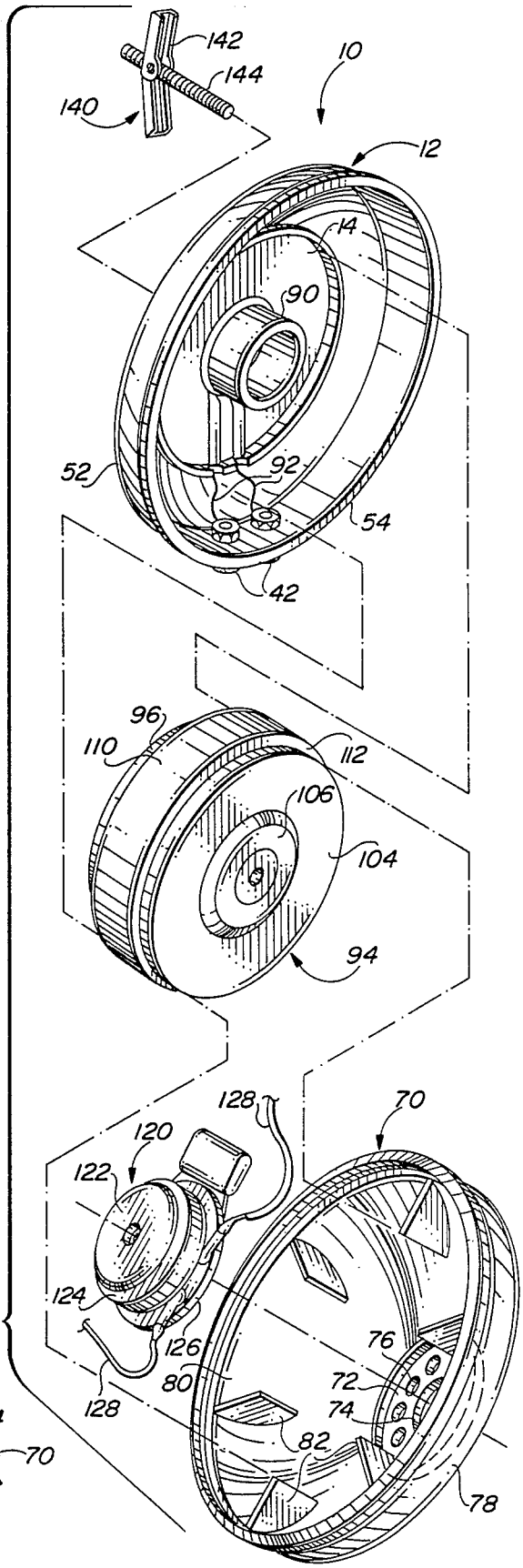
FIG. 3 is an exploded perspective view of the apparatus of the present invention.

FIG. 1 is a perspective view showing transducer apparatus 10 of the present invention secured to a wall 2. FIG. 2 is a view in partial section taken generally along line 2—2 of FIG. 1, showing both the wall 2 and the transducer apparatus 10 in partial section. FIG. 3 is an exploded perspective view of the transducer apparatus 10 with portions of the transducer apparatus rotated for purposes of clarification of the various elements involved in the transducer apparatus 10. For the following discussion, reference will primarily be made to FIGS. 1, 2, and 3.

The transducer apparatus 10 includes a housing base 12 and a housing top 60. Secured to the housing base 12 is a voice coil 90 and a magnet assembly 94. Secured to the housing top 60 is a tweeter 120.

The housing base 12, with the housing top or cover 60 secured thereto, is secured to the wall 2 by means of a toggle bolt 140.

Figure 4:
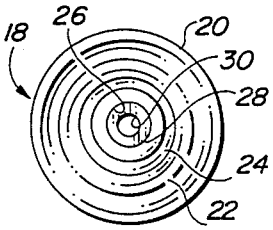
FIG. 4 is a view taken generally along line 4—4 of FIG. 2.

The housing base 12 includes a generally flat back portion 14 with a boss 16 extending outwardly from the base 12. The boss 16 includes a generally convex outer surface 18 which is disposed against the wall 2. The outer surface 18 of the boss 16 is shown in FIG. 2 in side elevation and is shown in FIG. 4 in plan view. FIG. 4 is an end plan view of the boss 16 taken generally along line 4—4 of FIG. 2. For details of the outer surface 18 of the boss 16, reference will be made to FIGS. 2 and 4.

The outer surface 18 includes a somewhat scalloped cross section, as shown in FIG. 2. The surface 18 includes an outer ridge 20 and a middle ridge 22 which are concentric to each other. The outer ridge 20 extends inwardly from the outer periphery of the outer surface. In the center is a planar portion 24.

Between the concentric ridges 20 and 22, and inside the inner ridge 22, are concentric grooves. The height of the ridges and the depth of the grooves are not respectively uniform because, as indicated above, and as shown in FIG. 2, the general configuration of the outer surface 18 is convex. The purpose of the concentric ribs or ridges 20 and 22 is to help transmit different frequencies to the wall 4.

A bore 26 extends inwardly from the planar portion 24. An insert 28 is disposed in the bore 26. The insert 28 includes a threaded interior bore 30. The insert 28 is a screw insert for receiving a threaded screw, as will be discussed below.

The boss 16 also includes a pinched waist 40. The boss 16 includes an interior boss 42 disposed concentrically within a cylindrical bore 44. The screw insert 28 extends into the interior boss 42 from the flat center portion 24 of the convex outer surface 18. The screw insert 28 is preferably a metal insert, with the interior threaded bore 30, while the rest of the housing base and the housing top are preferably made of some type of plastic material.

A relatively shallow groove 46 is disposed coaxially about the cylindrical bore 44 and it extends into the interior boss 42 from the flat back 14. The groove 46 receives a voice coil 90. The voice coil 90 extends outwardly from the groove 46, as shown in FIGS. 2 and 3, and as discussed below.

Figure 5:
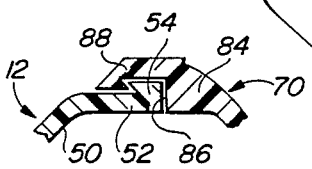
FIG. 5 is an enlarged view in partial section taken generally from Circle 5 of FIG. 2.

From the outer portion of the flat back 14, a tapering outer portion 50 fo the housing extends outwardly and upwardly. The tapering outer portion 50 terminates in an outer peripheral wall 52. On the outer wall 52 is a latch and groove portion 54, as best shown in FIG. 5. FIG. 5 is an enlarged view taken generally from circle 5 of FIG. 2, showing the connection between the base 12 and the cover or top 70. The latch and groove portion 54 cooperates with a mating portion of the housing top 70, as will be discussed below.

At about the juncture of the tapering outer portion 50 and the flat back 40, and on the interior of the housing base 12, there is a generally vertically extending circular rim 36. A shoulder 38 is disposed on the inside of the rim 36. Both the rim 36 and the shoulder 38 extend generally circularly and accordingly extend coaxially with the circular flat back 14 and with the cylindrical bore 44 and the coaxial groove 46.

An electrical connector boss 60 extends outwardly on the outwardly tapering portion 50. The electrical connector boss 60 includes appropriate electrical connectors or terminals 62 for providing electrical contact with the electrical elements disposed within the housing base 12 and the housing cover or top 70. This will also be discussed in detail below.

The housing top 70 includes a relatively flat center portion 72. Extending through the center portion 72, and generally coaxial therewith, is a center aperture 74. A plurality of smaller apertures 76 are disposed aabout the central aperture 74. The apertures 76 comprise a plurality of relatively small apertures, best shown in FIG. 1.

Extending upwardly and outwardly from the circular center flat portion 72 is a convex outer portion 78. The convex outer portion 78 includes a matching concave interior 80. A plurality of radially extending holder fins 82 extends inwardly from the concave interior 80.

At the outer periphery of the housing top 70 is a rim 84. A shoulder 86 extends inwardly on the interior of the rim 84. Extending outwardly from the rim 84 is a latch and groove portion 88. As best shown in FIG. 5, the shoulder 86 receives the outer portion of the peripheral wall 52 of the base 12. The latch and groove portions 54 and 88 are complementary, and they matingly engage each other to secure the base 12 and the cover or top 70 together.

The transducer apparatus 10 includes two magnetic elements, a relatively large magnet or magnetic assembly 94 and a relatively small tweeter 120. The relatively large magnetic assembly 94 includes a generally circular or cylindrical permanent magnet iron core 96. The magnet core 96 includes a rear or inner face 98. A cylindrical bore 100 extends inwardly from the rear face 98. Extending outwardly from the face 98 is a plurality of feet 102. As best shown in FIG. 2, the feet 102 are disposed against the inside of the flat portion 14 of the base 12. Thus, the feet comprise spacers between the face 98 of the iron core permanent magnet 96 and the back 14 of the housing base 12.

The iron core 96 also includes a front or outer face 104. A boss 106 extends outwardly from the outer face 104. The boss 106 has a flat front face 107.

A circular groove 108 extends inwardly from the outer periphery of the cylindrical portion of the core 96. A ferrite toroid 110 is disposed in the groove 108. The ferrite toroid 110 is generally of a slightly larger diameter than the core 96. Accordingly, an outer shoulder 112 is disposed between the core 96 and the ferrite toroid or ring 110. The shoulder 112 receives the holder fins 82 of the housing top 60 to hold the magnetic assembly 94 in the housing portions 12 and 70.

A permanent magnet insert 114 is disposed within the bore 100. The outer diameter of the permanent magnet insert 114 is less than the inner diameter of the bore 100. The insert 114 is coaxially disposed within the bore 100. The space between the outer diameter of the insert 114 and the inner diameter of the bore 100 defines or comprises an annular cavity into which the speaker coil 90 extends and in which the speaker coil 90 is movable disposed so that it may oscillate in response to input signals through the electrical terminals 62.

The voice coil 90 includes a pair of electrical conductors 92 which extend from the coil 90 to the terminals 62.

The tweeter 120 is of a generally similar construction to that of the magnetic assembly 94, discussed above. The tweeter 94 includes a permanent magnetic iron core 122 with a ferrite toroid 124 disposed in a groove in the core 122. The toroid 124 extends outwardly from the core 122 a small distance. A front cone element 126 is secured to the front of the core 122.

Electrical conductors 128 extend from the terminal elements 62 and are appropriately connected to a coil movably disposed within an annular cavity at the front of the core 122. The construction of both the magnetic assembly 94 and the tweeter 120 are well known and understood in the art. The conductors 148 are in parallel with the conductors 92 and thus receive the same electrical input signals from an appropriate source, not shown, through the terminals or contacts 62.

The front element 126 of the tweeter 120 is disposed on the center flat portion 72 of the housing top 70. The diameter of the flat 72 is substantially the same as the diameter of the element 126, and the tweeter accordingly is appropriately centered on the housing top 70 and coaxially aligned adjacent to the center aperature 74 and to the plurality of smaller apertures 76 which are circularly disposed about the center aperture 74.

When the housing top 70 is secured to the housing base 12, the radially extending fins 82 comprise holder fins that are disposed against the shoulder 112 to secure the magnetic assembly 94 in place in the housing base 12.

The outer diameter of the core 96 is substantially the same as the inner diameter of the circular rim 36. The outer periphery of the rear face 98 may thus be disposed on the shoulder 38 within the rim 36. The height of the feet 102 is substantially the same as the height of the shoulder 38 to provide additional support for the relatively heavy magnetic assembly 94 within the housing base 12.

As indicated above, the insert 28 which extends into the bore 26 from the flat portion 24 of the rear convex outer face 18 of the housing base is preferably metal, and includes an internally threaded bore 30 to cooperate with the toggle bolt 140 to secure the transducer apparatus 10 to the wall 2. The toggle bolt 140 is a well known element, which includes a pair of movable or toggle "wings" 142, disposed about a screw element 144. The "wings" 142 are spring biased to their outer or open position, as shown in FIG. 2.

For securing the apparatus 10 to the wall 2, a hole 4 is first drilled through the wall 2 at the location where the transducer apparatus 10 is to be located. The diameter of the hole 4 is about the same as the width of the wings 142 of the toggle bolt 140 when the wings are folded generally parallel to the threaded shank or screw 144. In this manner, the toggle bolt assembly is moved through the aperture 4. At such time as the wings 142 are completely through the hole 4, the wings spread to their open position. The threaded shank or screw 144 is then inserted into the mating threaded bore 30 of the insert 28 and rotation of the apparatus 10 causes an engagement between the threads of the shank 144 and the threaded bore 30 which tightens the wings 142 against the inner surface of the wall 2 to secure the apparatus 10 to the wall 2.

As best illustrated in FIG. 2, the diameter of the pinched waist 20 is slightly less than the diameter of the voice coil 90. This allows greater transmission of bass frequencies through the housing base 12 to the wall 2 than if the diameter of the rear boss 16 were uniformly as great or greater than the diameter of the voice coil 90. It will be noted that the maximum diameter of the boss is greater than the diameter of the voice coil 90.

It will also be noted that there is relatively minimum surface contact between the wall 2 and the boss 16. Accordingly, vibrations from the transducer apparatus 10 are more likely to be transmitted to the wall 2 from the magnetic assembly 94 and the housing portions 12 and 70 to allow the wall 2 to act as a speaker cone. The transducer 10 provides vibratory output from electrical input signals to enable the wall 2 to act as a speaker for the transducer apparatus 10. The vibratory output to the wall 2 is primarily from the magnetic assembly 94 in response to the input signals to the voice coil 90, as is well known and understood in the art.

The transducer apparatus 10 provides both high frequencies through the tweeter 120 and low and medium frequencies through the magnetic assembly 94. The vibrations from the two magnetic elements 94 and 120 are passed through the housing base 12 and top 60 through the boss 16 to the wall 2. By utilizing a securing device, such as a toggle bolt 140, there is less likelihood of the apparatus 10 becoming loose from the wall 2, such as may occur only a simple screw is utilized. Accordingly, the degree of attachment or contact between the transducer apparatus 10 and the wall 12 is maintained substantially constant at all times. If the transducer comes loose, obviously the rotation of the apparatus 10 with respect to the toggle bolt 140 allows for a tightening of the mechanical bond between the two, or the continuing mechanical bond between the two, if needed.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any all such modifications, within the limits only of the true spirit and scope of the invention.

What i claimed is:

1. Transducer apparatus for transmitting electromagnetic signals to a wall, comprising, in combination:

housing means for holding electromagnetic elements, including a base housing having a back portion, a voice coil extending inwardly from the back portion, and having a first diameter, for providing an electromagnetic output in response to an electronic input signal, a rear boss portion extending outwardly from the back portion of the base housing to the wall, having an outer surface disposed against the wall and having a pinched waist reduced diameter portion between the back portion and the outer surface which has a second diameter which is less than the first diameter of the voice coil, first magnetic element means disposed in the base housing and responsive to the output of the voice coil for providing a first output, a bore in the first magnetic element means into which the voice coil extends, a top housing secured to the base housing, and means for securing the first magnetic element means to the base housing;

means for securing the housing means to the wall; and means for providing an electronic input signal to the voice coil to provide an output transmitted to the wall from the first magnetic element means.

2. The apparatus of claim 1 in which the housing means further includes a generally convex outer surface on the rear boss portion.

3. The apparatus of claim 2 in which the housing means further includes concentric grooves and ridges on the generally convex outer surface.

4. The apparatus of claim 1 in which the housing means further includes second magnetic element means for providing a second output, and means for connecting the second magnetic element to the means for providing an electronic input signal.

5. The apparatus of claim 4 in which the second magnetic element means is secured to the top housing.

6. The apparatus of claim 5 in which the second magnetic element means comprises a tweeter.

7. The apparatus of claim 1 in which the means for securing the housing means to the wall includes a screw element secured to the wall and to the rear boss portion.

8. The apparatus of claim 1 in which the means for securing the first magnetic element means to the base housing includes a plurality of fins secured to the top housing and contacting the first magnetic element means when the top housing is secured to the base housing.

9. The apparatus of claim 1 in which the rear boss portion of the housing means has a third diameter which is greater than the first diameter of the voice coil.

10. Transducer apparatus for transmitting electromagnetic signals to a wall, comprising, in combination:

housing means for holding electromagnetic elements, including a base housing having a back portion, a first voice coil extending inwardly from the back portion for providing an electromagnetic output in response to an electronic input signal, a rear boss portion extending outwardly from the back portion of the base housing to the wall, first magnetic element means disposed in the base housing and responsive to the output of the voice coil for providing a first output, a bore in the first magnetic element means into which the voice coil extends, a top housing secured to the base housing, and means for securing the first magnetic element means to the base housing;

second magnetic element means secured to the top housing for providing a second output;

means for securing the housing means to the wall;

means for providing an electronic input signal to the voice coil to provide an output transmitted to the wall from the first magnetic element means and to the second magnetic element means to provide the second output.

11. The apparatus of claim 10 in which the top housing of the housing means includes aperture means adjacent to the second magnetic element means.

12. The apparatus of claim 11 in which the seocnd magnetic element means comprises a tweeter whose output is transmitted outwardly from the top housing through the aperture means in the top housing.

13. The apparatus of claim 10 in which the voice coil has a first diameter and the real boss portion of the housing means includes a pinched waist portion having a second diameter which is less than the first diameter of the voice coil.

14. The apparatus of claim 10 in which the rear boss portion of the housing means includes a generally convex outer surface adapted to contact the wall.

* * * * *